US006899391B1

(12) United States Patent
Schneller et al.

(10) Patent No.: US 6,899,391 B1
(45) Date of Patent: May 31, 2005

(54) SEAT BACK WITH FLAP TO HOLD INDICIA

(76) Inventors: Lewis Schneller, 2019 W. Sussex Ave., Missoula, MT (US) 59801; Ingrid Schneller, 1801 N. Justin La., Tucson, AZ (US) 85712

( * ) Notice: Subject to any disclaimer, the term of this patent is extended or adjusted under 35 U.S.C. 154(b) by 0 days.

(21) Appl. No.: 10/721,535

(22) Filed: Nov. 25, 2003

(51) Int. Cl.[7] ..... A47C 1/08

(52) U.S. Cl. ..... 297/252; 297/188.04; 297/228.1; 297/223; 297/230.11; 297/219.1; 297/352; 297/31; 40/593; 40/611.1

(58) Field of Search ..... 297/188.04, 228.1, 297/223, 230.11, 219.1, 230.1, 252, 352, 31, 41; 40/593, 611.1

(56) References Cited

U.S. PATENT DOCUMENTS 1,304,753 A * 5/1919 Dwyer ..... 297/218.4
2,137,312 A 4/1938 Thompson
2,688,998 A * 9/1954 Erickson et al. ..... 297/219.1
3,066,980 A 12/1962 Clute
3,479,085 A * 11/1969 Weinstein ..... 297/228.1
4,385,782 A 5/1983 Clark, Jr.
4,441,271 A 4/1984 Hutchinson
4,650,103 A * 3/1987 Mitchell ..... 224/275
5,421,637 A 6/1995 Lemburg
D363,951 S 11/1995 Chatman
5,584,422 A 12/1996 Bond-Madsen
5,690,380 A * 11/1997 Waters ..... 297/225
5,887,942 A 3/1999 Allegro, Jr.
5,979,975 A 11/1999 Hiraoka
6,076,211 A 6/2000 Chatman
6,082,816 A 7/2000 Gottlieb et al.
6,309,017 B1 * 10/2001 Middleton ..... 297/219.1
6,594,838 B1 7/2003 Hollander et al.

* cited by examiner

*Primary Examiner*—Laurie K. Cranmer
(74) *Attorney, Agent, or Firm*—Saliwanchik, Lloyd & Saliwanchik

(57) ABSTRACT

A seat back for a chair has a support panel to contact a seated person and a flap that extends from the top of that support panel to which advertising is attached. The flap folds over the back of the top of the support panel and presents the advertising to a person seated behind the chair fitted with the seat back. The seat back is particularly useful to convey advertising messages in stadium settings.

2 Claims, 4 Drawing Sheets

SEAT BACK WITH FLAP TO HOLD INDICIA

BACKGROUND OF THE INVENTION

On any given fall Saturday afternoon, the seats of a college football stadium are filled to capacity. Stadium seating allows a maximum number of people to occupy a given space. Advertisers have realized that stadium spectators are a captive audience. Advertisers' sponsorship is apparent not only on score boards and equipment, but advertisers now sponsor entire events having college bowl games named for themselves. Several methods of advertising and products associated with advertising have been described for the stadium market. For example, seat cushions, cardboard seat supports and adhesive bags for stadium seating have been devised to sport advertising (U.S. Pat. Nos. 3,066,980; 4,385,782; 4,441,271; 5,421,637; 5,584,422; 5,887,942; 5,979,975; 6,076,211; D 363,951; 6,082,816; and 6,594,838). Because there are further opportunities to advertise in the stadium environment, a need remains for additional methods by which to present a company's advertising to stadium spectators.

All patents, patent applications, provisional patent applications and publications referred to or cited herein, are incorporated by reference in their entirety to the extent they are not inconsistent with the explicit teachings of the specification.

SUMMARY OF THE INVENTION

The invention involves a seat back that has a flap to hold advertising. The flap extends from the top of a support panel of the seat back and folds over the back of the seat. Advertising attached to the flap is presented to the person sitting behind the chair fitted with the seat back. The advertising can be attached to the flap in a number of ways but preferably, the advertising is slid behind a transparent window attached to the flap into a pocket. Advertising can be easily seen through the transparent window and the advertising can be readily changed for each new event.

DETAILED DESCRIPTION OF THE INVENTION

The invention involves a seat back for a chair that has a flap that extends beyond the top of the chair seat and drops over the back of the seat. Advertising attached to the flap is presented to a person seated behind the chair having the subject seat back.

Figure 1:
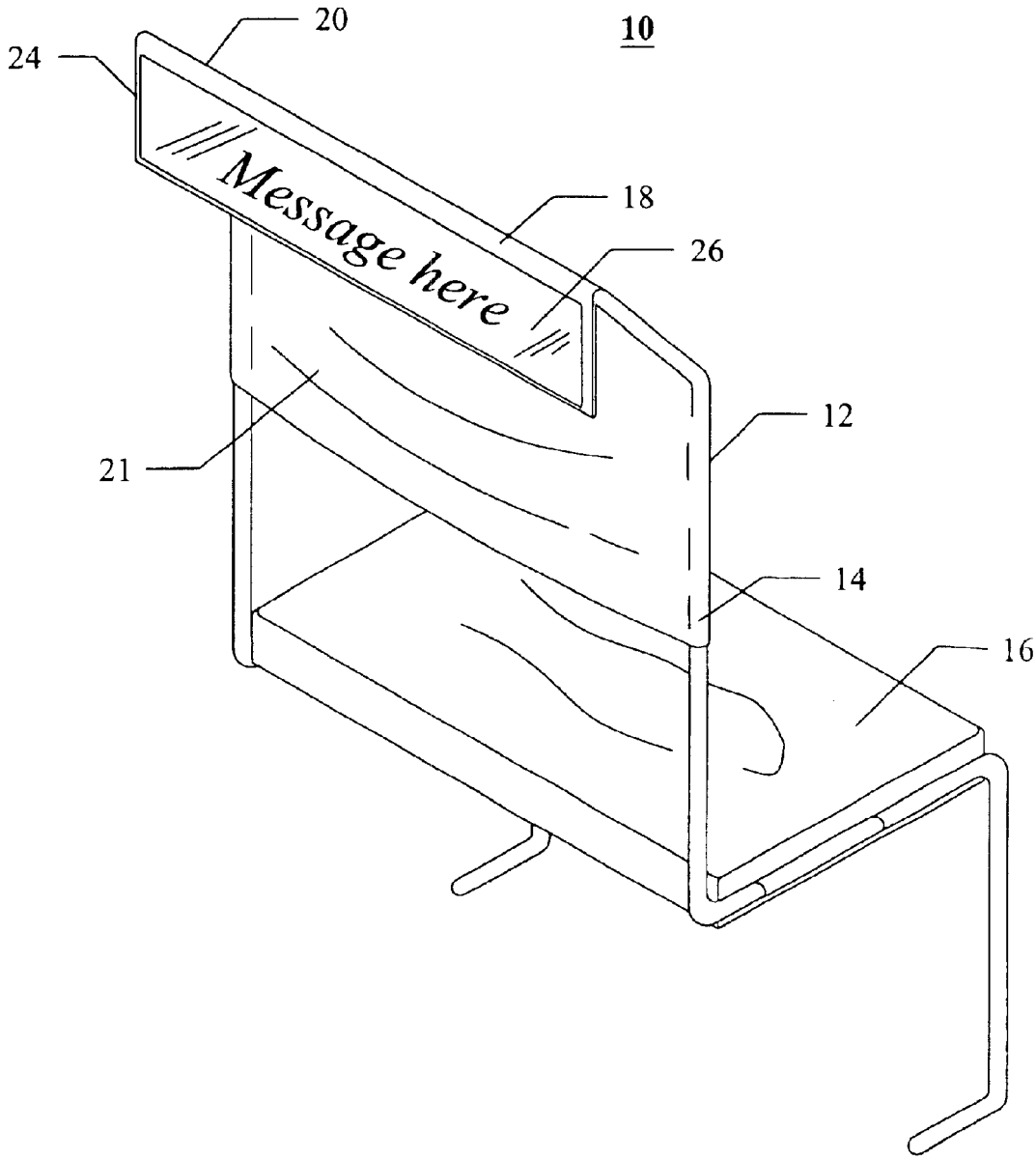
FIG. 1 is a rear isometric view of a preferred embodiment of the seat back of the subject invention.

A preferred embodiment of the seat back of the subject invention is shown generally at 10 in FIG. 1. The seat back has a support panel 12 for contacting a seated person. The support panel 12 has an end 14 proximate a chair seat 16 and an end 18 distal the chair seat. The end 18 distal the chair seat 16 is the top of the support panel. The front 20 of the support panel 12 contacts a seated person. The back 22 of the support panel 12 is opposite the front. The flap 24 extends from the top of the support panel and flops over toward the back 22 of that panel. Indicia such as advertising or items such as sample products can be attached to the flap 24 on a surface contiguous with the front 20 of the support panel 12. Advertising or the like attached to the flap are presented to a person sitting behind the subject seat back.

In the embodiments shown in FIGS. 1–4, the seat back of the subject invention has a back panel 21 opposite the support panel to form an envelope. The envelope can be slipped over, for example, the metal frame of a standard stadium chair (U.S. Pat. No. 2,137,312) as shown in FIG. 1. The metal frame has a slight bend near the top of the chair's frame. The flap 24 hangs vertically from the top of the frame. A message or advertising on the flap is clearly presented to a person sitting behind the seat back of the subject invention.

Figure 2:
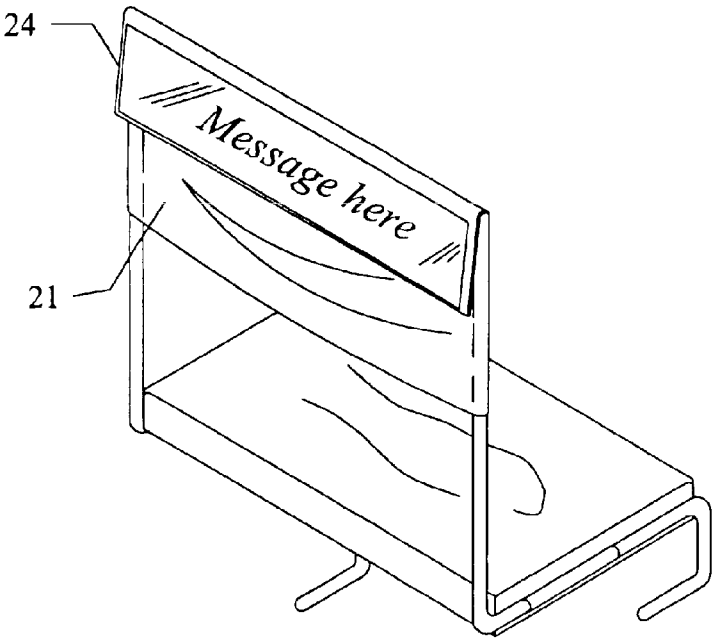
FIG. 2 is a rear isometric view of another preferred embodiment of the seat back of the subject invention.

FIG. 2 shows that a chair frame need not have a bend near the top of the frame to take advantage of the seat back of the subject invention. The stiff fabric of which the seat back is constructed holds the flap away from the back of the support panel presenting the indicia on the flap to someone seated behind the subject back. The seat back must be made of materials that will withstand repeated use and in some cases withstand the effects of rain, snow and sun. A number of materials can be used to make the subject seat back. Preferably, however, these are rugged, pliable materials that can withstand wear and the elements but fold to form the flap portion. These materials include, but are not limited to rip-stop nylon and malleable foams. Less stiff materials may create a flap that contacts the back of the support panel. Advertising displayed on these flaps is still readily viewed by a person sitting behind the subject scat back.

Figure 3:
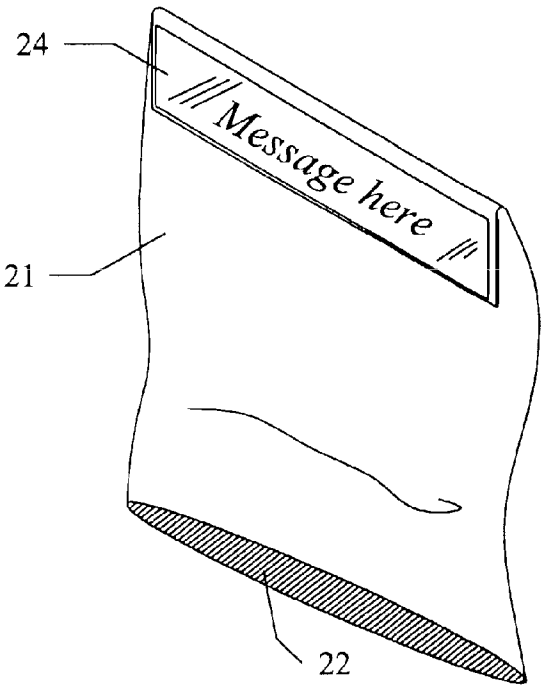
FIG. 3 is a rear isometric view of a preferred embodiment of the seat back of the subject invention.

FIG. 3 shows the preferred embodiment of the seat back of the subject invention as a simple slip cover with a back panel 21 opposite the support panel 12. The flap portion is formed by both panels. This slip cover is not only applicable to the metal frame of a stadium chair but can also be supported by the back of a theater-type seat. Theater-type seats are often used in indoor as well as outdoor stadium settings. The seat back of the subject invention slips over the back of the theater chair offering an inexpensive way for advertisers to modify these seats to include their promotional materials.

Figure 5:
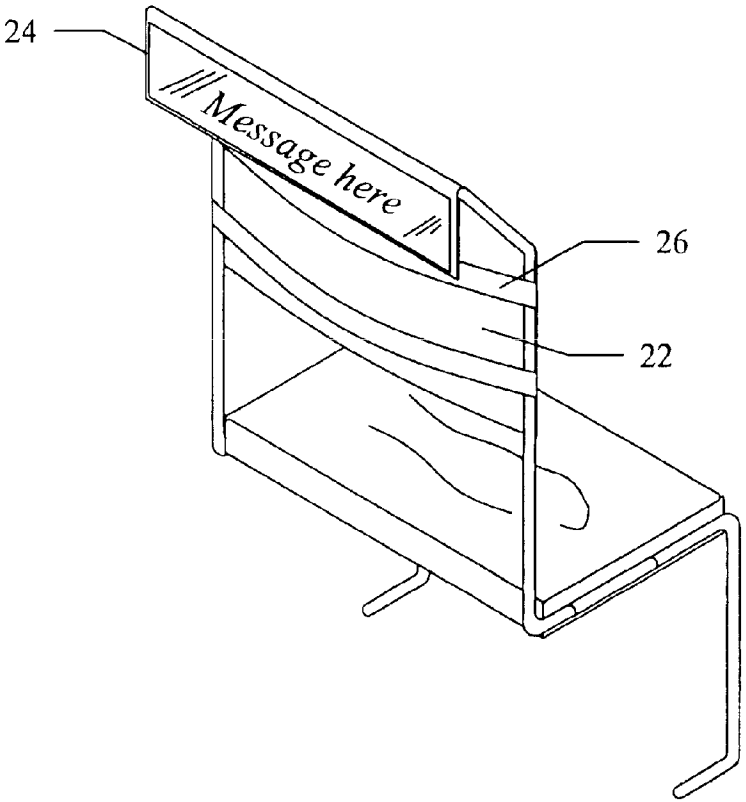
FIG. 5 is a rear isometric view of another preferred embodiment of the seat back of the subject invention.
Figure 4:
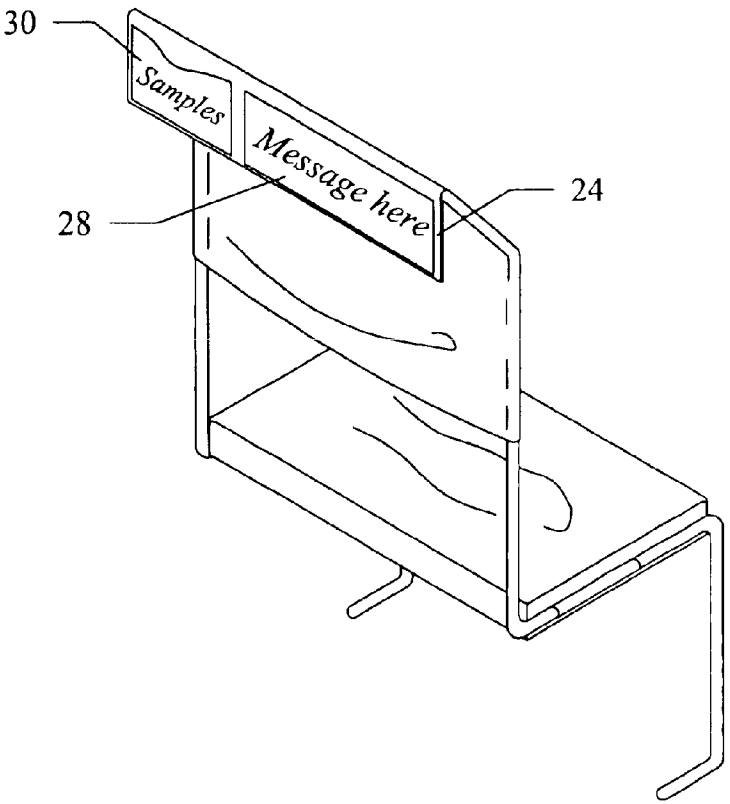
FIG. 4 is a rear isometric view of another preferred embodiment of the seat back of the subject invention.

FIG. 5 shows that the seat back of the subject invention need not have a back panel or form an envelope. The support panel of the seat back can be attached to a metal frame or chair back by straps 26 or elastic bands. Further, a short back panel could serve to secure the subject seat back to a frame. Therefore, the length of the support panel as well as the length of the back panel can vary on the subject apparatus. Alternatively, the support panel can stand alone.

It is noted that, in the embodiments shown, the seat backs are supported by a frame or a chair back. The seat backs of the subject invention however can stand alone providing support for a seated person or can further be modified to include padding for additional comfort. In all embodiments the seat backs have a flap at the top of the seat back that drop back toward the back of the chair to support indicia or promotional material.

Figure 6:
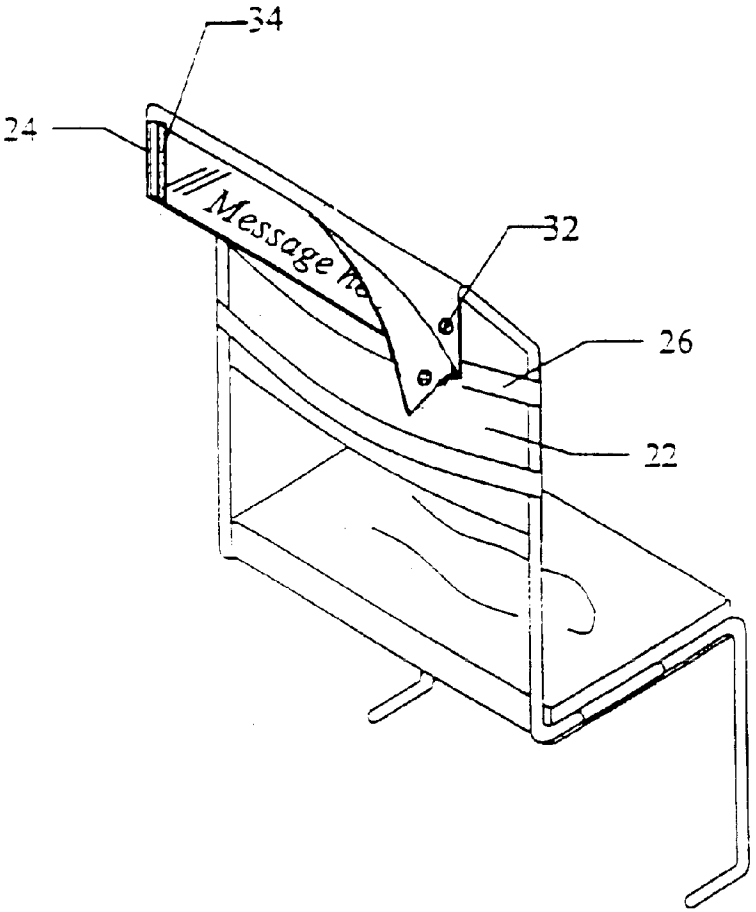
FIG. 6 is a rear isometric view of another preferred embodiment of the seat back of the subject invention.

Indicia or other items are attached to the flap on the seat back of the subject invention. Advertising or a message could be printed on the flap, for example, by silk screen. In a particularly preferred embodiment, indicia are interchangeable and are slipped behind a transparent window 28. The window can be open at the side or along the top to allow insertion and replacement of printed indicia. The sleeve created by the window can remain unsealed or can be permanently or temporarily sealed by methods including, but not limited to, hook and loop tape or a closing tab. A number of means can be used on the seat back of the subject invention to capture and hold advertising indicia and/or other promotional items. For example, placards or small sample bottles of product can be attached to the flap using complimentary hook and loop tape 32, elastic loops 34, grommets and plastic ties or snaps (FIG. 6). Small pockets 30 can be placed in or on the flap to hold sample items. A combination of a display window 28 and pockets 30 allow an advertiser to provide informative dialog together with a sample (see FIG. 4).

It is contemplated that the subject seat back will be used by advertisers to promote their products. It is noted however that the seat back of the subject invention can be used to display team logos or cheers. Further, the display space on the flap of the subject seat back can be used to present public service information.

It is understood that the foregoing examples are merely illustrative of the present invention. Certain modifications of the apparatuses and/or methods employed may be made and still achieve the objectives of the invention. Such modifications are contemplated as within the scope of the claimed invention.

What is claimed is:

1. A seat back for a chair comprising:

a support panel to contact a seated person;

a back panel opposite the support panel forming an envelope; and a flap portion formed by the support panel and the back panel, the flap portion extending from a top of the support panel and the back panel and folding over the top and toward a back panel, the flap portion having a transparent window affixed thereto to receive and display indicia.

2. A seat back for a chair comprising:

a support panel to contact a seated person;

a back panel opposite the support panel forming an envelope; and a flap portion formed by the support panel and the back panel, the flap portion extending from a top of the support panel and the back panel and folding over the top and toward a back panel, the flap portion capable of displaying indicia.

* * * * *